US005220396A

United States Patent [19]

Monma et al.

[11] Patent Number: 5,220,396

[45] Date of Patent: Jun. 15, 1993

[54] SHEET SEPARATING MECHANISM

[75] Inventors: Yoshio Monma, Saitama; Hiroyuki Yamaguchi, Tokyo, both of Japan

[73] Assignee: Asahi Kogaku Kogyo Kabushiki Kaisha, Tokyo, Japan

[21] Appl. No.: 835,075

[22] Filed: Feb. 18, 1992

Related U.S. Application Data

[63] Continuation of Ser. No. 634,603, Dec. 27, 1990, abandoned.

[30] Foreign Application Priority Data

Dec. 28, 1989 [JP] Japan ..... 1-344120

[51] Int. Cl.[5] ..... G03G 15/00

[52] U.S. Cl. ..... 355/315; 271/312; 355/274; 355/309

[58] Field of Search ..... 271/307, 312; 355/271, 355/274, 277, 309, 315

[56] References Cited

U.S. PATENT DOCUMENTS 4,110,027 8/1978 Sato et al. ..... 355/274
4,392,738 7/1983 Fujino et al. ..... 355/271
4,739,362 4/1988 Kau et al. ..... 355/277
5,023,667 6/1991 Negoro et al. ..... 355/274

FOREIGN PATENT DOCUMENTS 0013730 8/1980 European Pat. Off. .
2-103076 4/1990 Japan .

*Primary Examiner*—Joan H. Pendegrass
*Assistant Examiner*—P. Stanzione
*Attorney, Agent, or Firm*—Sandler, Greenblum & Bernstein

[57] ABSTRACT

In an electrophotographic printer using a continuous-form sheet as a recording medium, there is provided a sheet separating mechanism comprising an elastic member arranged to be deformed by the continuous-form sheet, that is pressed by a transferring charger, when the transferring charger is located at an operating position and a transferring operation is to be executed, or to be released from the deformation when the transferring charger is retracted from the operating position. Thus, the continuous-form sheet is definitely separated from a photoconductive material by the elastic member as it is released from the deformation, when the transferring operation is not to be executed.

5 Claims, 4 Drawing Sheets

SHEET SEPARATING MECHANISM

This application is a continuation of application Ser. No. 07/634,603, filed Dec. 27, 1990, now abandoned.

BACKGROUND OF THE INVENTION

The present invention relates to a printing device utilizing a continuous-form recording sheet on which a printing operation is to be executed by a so-called electrophotographic system. The system has a transfer charger retraction mechanism for retracting a transfer charger used in the electrophotographic system from an operating position thereof, when the printing operation is not executed. This specifically relates to a printing device capable of definitely separating the continuous-form recording sheet that has been pressed to a photoconductive drum by means of the transfer charger, from the photoconductive drum by retraction of the transfer charger.

A conventionally known image forming apparatus, such as a printer, makes use of the electrophotographic system, by which a latent image is formed by exposing a photoconductive agent on a surface of a photoconductive drum which is arranged to be rotated in the presence of light. The latent image is developed by adhering toner thereto. The toner is transferred onto a recording sheet arranged to be synchronously fed with the rotation of the photoconductive drum. Finally, the transferred toner is fixed by means of a fixing unit. As an image forming apparatus, there is an electrophotographic printer for printing information on a folding-type continuous sheet with feed holes, which is called a fan-folded sheet that is similar to that used in a conventional line printer and the like.

The fan-folded sheet is arranged in such a manner that a boundary of each of the pages thereof is provided with a perforated tear line for cutting, and thus, the fan-folded sheet is alternately folded along the perforated tear line in the opposite direction and delivered to the image forming apparatus in a stacked state.

Incidentally, a printer using the continuous-form sheet as a recording medium must begin the printing operation at a position such that each of the pages is separated apart from the perforated tear line for a predetermined distance. That is, the printing operation is started at a position separated from a leading edge of the sheet in a direction along which the printing operations are executed. In the above arrangement of the electrophotographic system, an exposure unit, a development unit and a transfer unit are disposed around the photoconductive drum and put into operation sequentially as the photoconductive drum is rotated. Thus, an image is transferred when the exposed portion of the photoconductive drum gets to a transfer position during the rotation of the photoconductive drum. Therefore, a print start point on the continuous-form sheet must be adjusted by relatively moving, i.e., rotating, the photoconductive drum with respect to the continuous-form sheet. In other words, before the printing operation is executed, it is necessary to control a positional relationship between the image forming start position on the photoconductive drum and the continuous-form sheet, in such a manner that the position of the photoconductive drum, at which exposure is to be started, coincides with the print start position of the page of continuous-form sheet.

If the continuous-form sheet is kept in contact with the photoconductive drum, i.e., in a transfer state, during the above-described position adjusting operation, a problem arises in that the photoconductive agent on the surface of the photoconductive drum is scratched or worn shortening the life of the photoconductive drum. Alternately, the continuous-form sheet is stained with toner remaining on the surface of the photoconductive drum. To cope with this problem, there have been prior art systems for retracting the transfer charger from the operating position, at which the transfer charger causes the continuous-form sheet to contact the photoconductive drum, disclosed in, for example, Japanese Patent Provisional Publication HEI 2-103076. In such conventional charger retracting systems, the transfer charger is designed to be retracted upon the end of a feeding operation of the continuous-form sheet.

Nevertheless, a problem arises in that even if the transfer charger is retracted from the operating position after completion of the printing operation, the continuous-form sheet, having been synchronously fed with a rotation of the photoconductive drum at a predetermined speed, cannot be instantly stopped. Then, the continuous-form sheet is fed slightly further by the inertia thereof. Thus, the portion of the continuous-form sheet to be contacted with the photoconductive drum is loosened, because the continuous-form sheet is fed by a feeding mechanism located at a downstream side of the photoconductive drum. Therefore, even if the transfer charger is retracted, the continuous-form sheet is contacted with the photoconductive drum, resulting in the continuous-form sheet being stained by the toner when the printing is resumed. This problem is more often caused when the folding direction of the perforated tear line is projected toward the photoconductive drum side.

SUMMARY OF THE INVENTION

It is therefore an object of the invention to provide an improved sheet separating mechanism capable of separating the continuous-form sheet from the photoconductive drum when the transfer charger is retracted from the operating position.

For this purpose, according to the present invention, there is provided a sheet separating mechanism, adapted to be positioned in an electrophotographic printer using a continuous-form sheet. A visible image has been formed on a predetermined photoconductive material that is transferred by means of a transferring charger movable between an operating position, in which the transferring charger presses the continuous-form sheet, being fed in a predetermined direction, on the predetermined photoconductive material, and a retracting position in which the transferring charger is retracted from the operating position, for separating the continuous-form sheet from the predetermined photoconductive material when the transferring charger is located at the retracting position.

The charger retracting mechanism comprises an elastic member arranged to be deformed by the continuous-form sheet that is pressed by the transferring charger when the transferring charger is located at the operating position, or to be released from the deformation when the transferring charger is located at the retracting position.

DESCRIPTION OF THE ACCOMPANYING DRAWINGS

DESCRIPTION OF THE EMBODIMENTS

Figure 1:
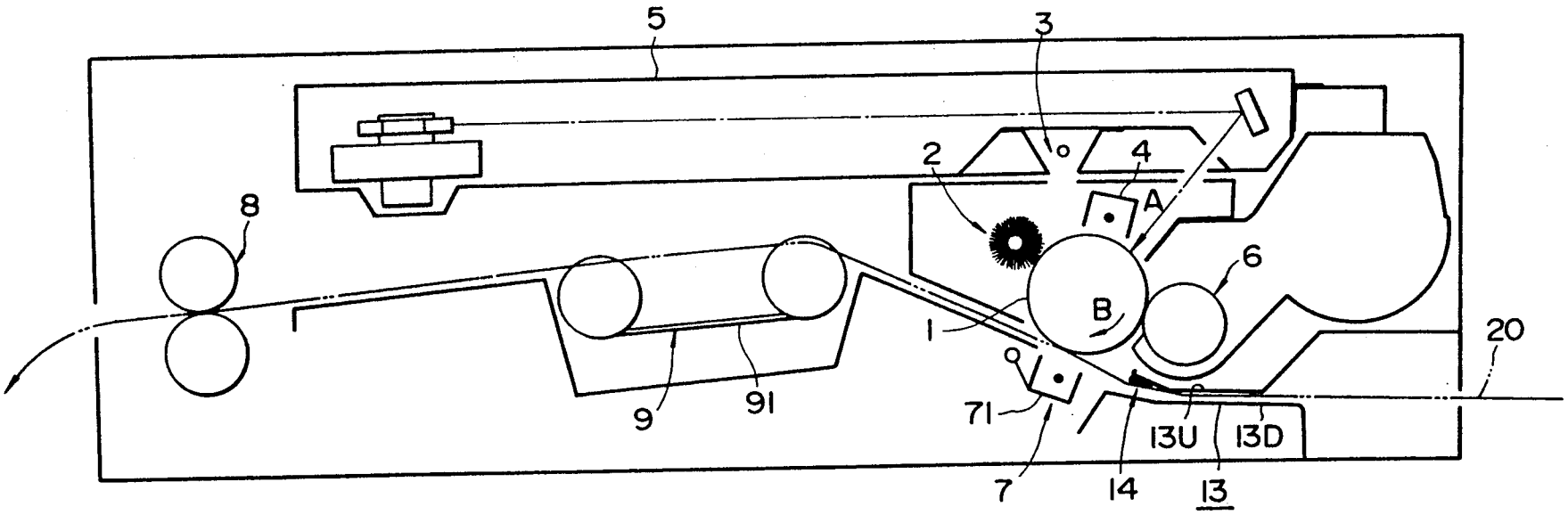
FIG. 1 is a side view showing a schematic arrangement of a printer provided with an embodiment of a recording sheet retraction acceleration mechanism, according to the present invention, in which a continuous-form recording sheet is used.

Referring to the drawings, an embodiment of the present invention will be described hereinafter.

FIG. 1 shows a laser beam printing device, using a continuous-form fan-folded sheet as a recording medium, by which character information inputted from a computer and the like are printed on the continuous-form sheet 20 by an electrophotographic system.

A toner cleaning unit 2, a discharging unit 3, a charging unit 4, a scanning optical system 5 for introducing a laser beam to a photoconductive drum 1 as indicated by an arrow "A", a development unit 6, and a transfer unit 7 are disposed, respectively, around the photoconductive drum 1 that rotates in the direction indicated by an arrow "B". Further, a fixing unit 8 is disposed at the downstream side of the photoconductive drum 1, and a tractor 9, through which the continuous-form sheet 20 is fed toward the fixing unit 8, is disposed as shown in FIG. 1. The tractor 9 is arranged such that a tractor belt 91, which has projections, not shown, that engage the feed holes of the continuous-form sheet 20 that are defined at both side edges thereof, is disposed.

As the photoconductive drum 1 is rotated in the "B" direction, the surface thereof is scanned by the laser beam from the scanning optical system 5, having been modulated by the image information to be developed, to form an electrostatic latent image. Toner is adhered to the latent image at the development unit 6 to form a visible image corresponding to the latent image. The toner image is transferred onto the continuous-form sheet 20 at the transfer unit 7 and fixed on the continuous-form sheet 20 at the fixing unit 8.

Figure 2A:
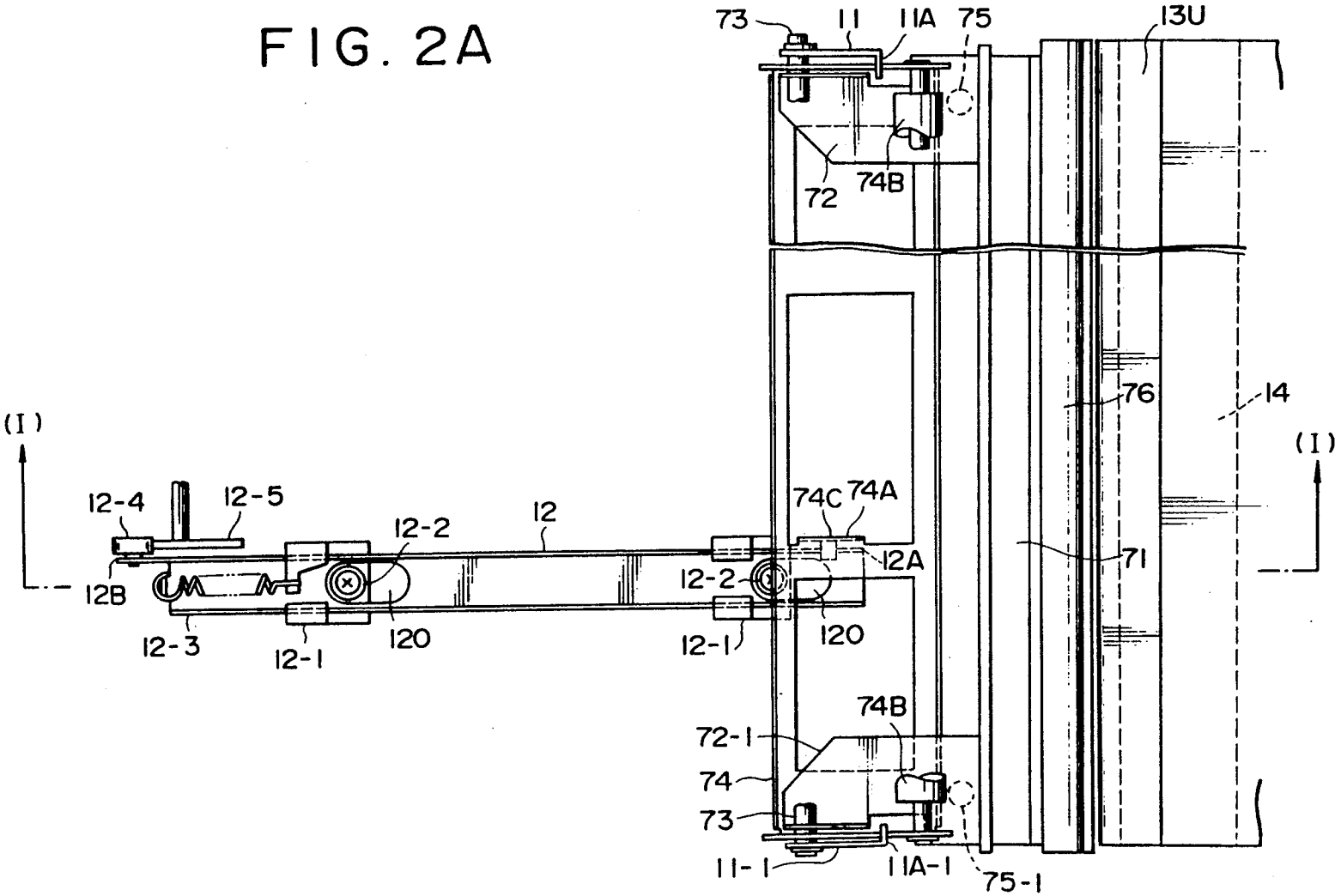
FIG. 2A is a plan view of a transfer unit of the printer shown in FIG. 1.
Figure 2B:
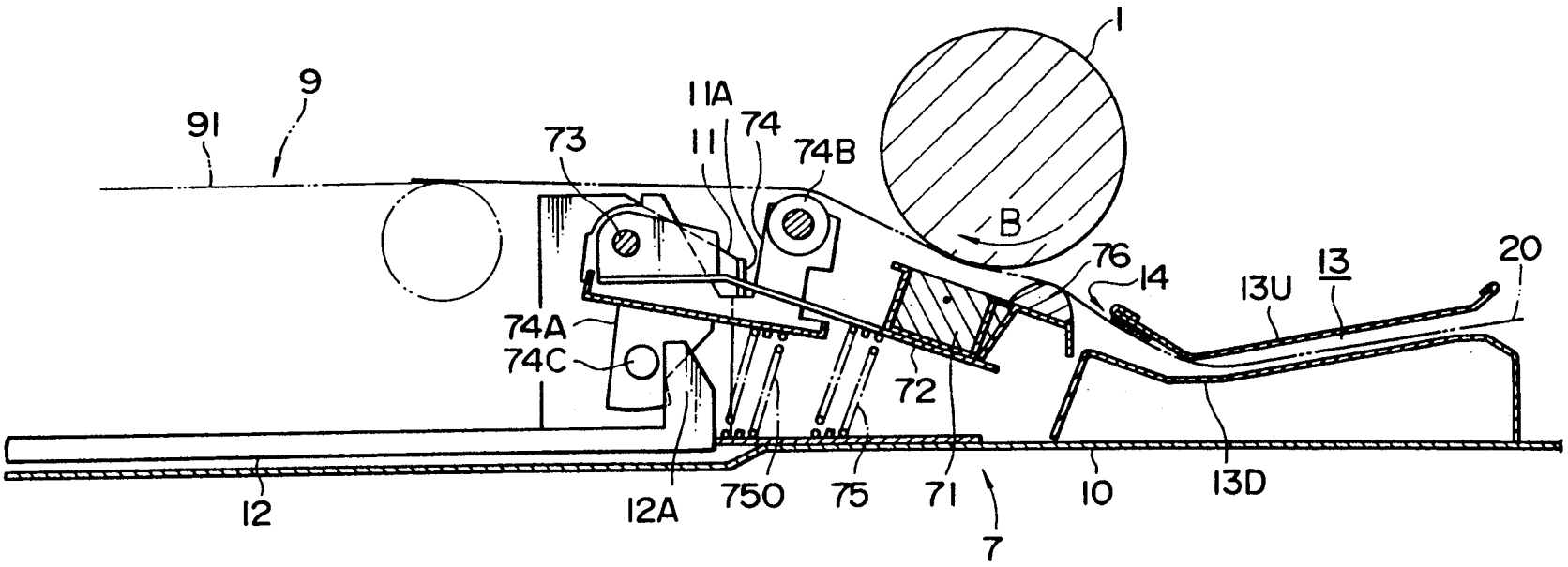
FIG. 2B is a partially enlarged diagram of a transfer unit of the printer shown in FIG. 1 in which a transfer charger is located at the operating position.

FIG. 2A shows a plan view of the transfer unit 7 employed in the printer shown in FIG. 1. FIG. 2B shows a partial sectional view sectioned along the line (I)—(I) of FIG. 2A. As shown in FIGS. 2A and 2B, the transfer unit 7 is arranged such that a corona electrical charging unit 71 is held at the opposite ends thereof by a pair of arms 72 and 72-1 that are rockably supported through a fulcrum 73 by a pair of brackets 11 and 11-1 that are both standing on a chassis 10 of the laser beam printer device. Thus, the corona electric charging unit 71 is in parallel with a rotating shaft of the photoconductive drum 1 and retractable from the operating position.

In the operating position, the arms 72 and 72-1 are upwardly urged by a pair of springs 75 and 75-1 that are interposed between the lower surface of the arms and the chassis 10 enabling the corona electric charging unit 71 to be located at a predetermined position at which a transfer operation is carried out by the corona electric charging unit 71. Further, a pressing member 76, having a semi-circular cross section, is adjacently located with the corona electric charging unit 71. When the corona electric charging unit 71 is located at the operating position, the pressing member 76 upwardly presses the continuous-form sheet 20 toward the photoconductive drum 1, so that the transfer operation is to be executed on the continuous-form sheet 20.

A sheet presser 74 having a lever 74A downwardly projecting from the lower surface thereof, is rockably supported by the fulcrum 73 by which the arms are supported and upwardly biased by another pair of springs 750 and 750-1 and stopped by a pair of stopper portions 11A and 11A-1, respectively provided on the brackets 11 and 11-1. A slide plate 12 is mounted on the chassis 10 of the laser beam printer device in such a manner that it can be slidingly moved along guide plates 12-1, respectively, fixed to the chassis 10 by means of screws 12-2. A sheet feed roller 74B is provided on the sheet presser. The continuous-form sheet 20 is fed on the sheet feed roller 74B.

On the slide plate 12, a plurality of oval holes 120 are provided. The slide plate 12 can be slidingly moved in an amount of length of the oval holes 120. One of the ends of a spring 12-3 is connected to one of the guide plates 12-1, and the other end is connected to the slide plate 12, as shown in FIG. 2A. Further, one of side walls 12B of the guide plate 12 is connected to a cam follower 12-4, which is arranged to be brought into contact with a cam 12-5 having a small diameter portion and a large diameter portion corresponding to the operating position of the charging unit 71 and a retracting position, respectively. When the charging unit 71 is located at the operating position, the small diameter portion of the cam 12-5 is brought into contact with the cam follower. When the transfer charger 7 is to be retracted from the operating position, the cam 12-5 is rotated by means of a not-shown driving source, such as a motor. The cam follower 12-4 is moved along a sheet feeding direction as the cam 12-5 is rotated, and then, the slide plate 12 is slidingly moved.

Figure 3:
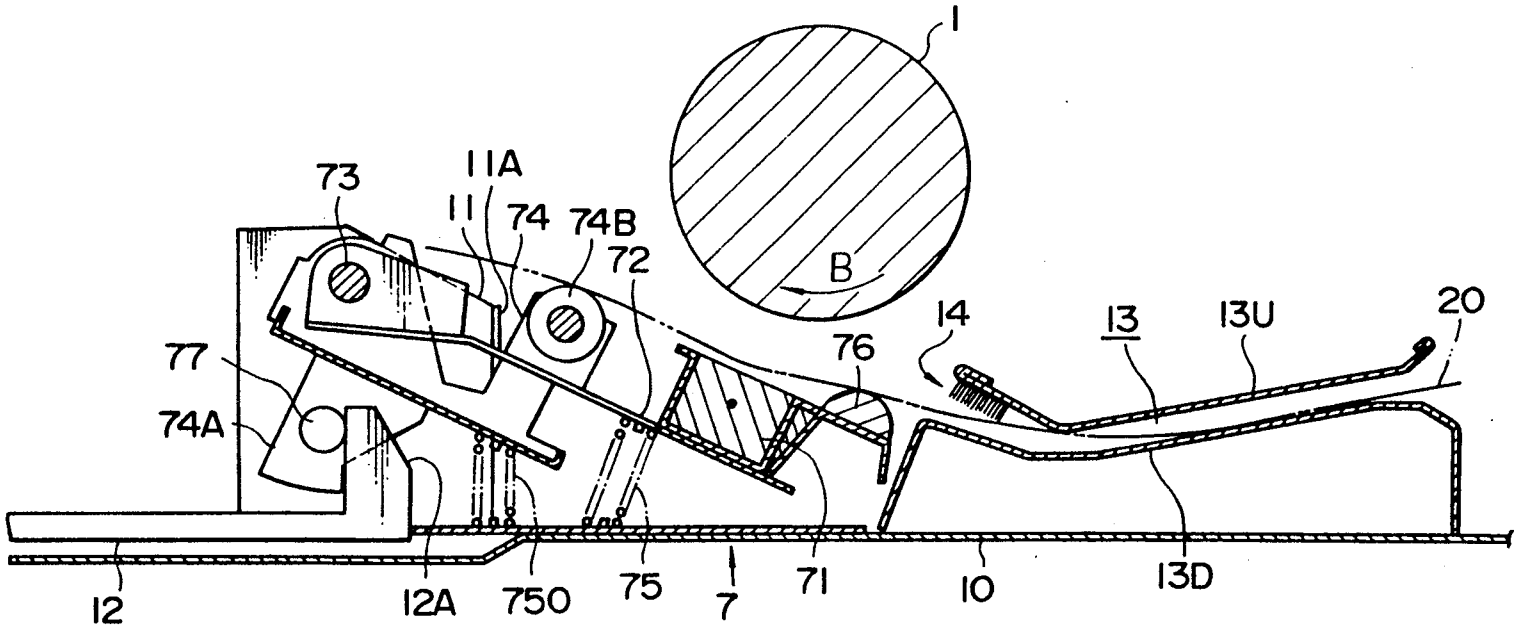
FIG. 3 is the partially enlarged view of the transfer unit, shown in FIG. 2B in which the transfer charger is retracted from the operating position thereof.

When the slide plate 12 is slidingly moved in the sheet feeding direction, the operating portion 12A of the slide plate 12, erectly formed at the end thereof, is engaged with a pin 77 that is horizontally projected from a lever portion 74A of the paper presser 74. This causes the sheet presser 74 to be rocked clockwise in the drawing of FIG. 2B, so that, as shown in FIG. 3, the sheet presser 74 downwardly pushes the arms 72 and 72-1 against the urging force of the springs 75 and 75-1. Thus and thus the corona electric charging unit 71 is downwardly retracted from the operating position.

Upper and lower guides 13U and 13D, serving as a recording sheet guide members, are opposed in predetermined intervals at the upstream side of the transfer unit 7. The continuous-form sheet 20 reaches the transfer unit 7 through a recording medium feeding path 13 that is defined between the upper and lower guides 13U and 13D.

Each of the upper and lower guides 13U and 13D are formed downwardly in a predetermined angle at an introduction side thereof and then bent upwardly toward the transfer unit 7 in an intermediate portion thereof. Further, a brush 14 which is having a predetermined width and covering the entire width of the continuous-form sheet 20, is attached on the upper guide 13U on the recording medium feeding path 13, at the edge side opposed to the transfer unit 7.

The brush 14 is provided with wires which are densely planted thereon with each of the wires having a predetermined diameter and length. The wires can be bent by a very weak force and the extreme ends thereof are projected toward the recording medium feeding path 13.

In the above arrangement, when printing is carried out with the corona electric charging unit 71 located at the operating position, the continuous-form sheet 20, which arrives at the transfer unit 7 after having been passed through the recording medium feeding path 13, which is defined by the upper and lower guides 13U and 13D, is pressed upwardly toward the photoconductive drum 1 by the pressing member 76. Thus the upper surface thereof comes into contact with the photoconductive drum 1 and the brush 14 which is attached to the exit of the upper guide 13U. Thus, each of the wires of the brush 14 are pressed upwardly by the continuous-form sheet 20 and forwardly bent in the direction along which the continuous-form sheet 20 is fed.

Upon completion of the printing operation, i.e., when the printing operations are not to be carried out, the feeding operation of the continuous-form sheet 20 is stopped, the slide plate 12 is slidingly moved, and the arms 72, 72-1 are rocked causing the corona electric charging unit 71 to be retracted from the operating position. At the time, the continuous-form sheet 20 is loosened between the photoconductive drum 1 and the corona electric charging unit 71 due to the inertia produced when the continuous-form sheet 20, having been fed at a predetermined speed, is stopped.

At that time, if the continuous-form sheet 20 is loosened toward the photoconductive drum 1 side, the continuous-form sheet 20 is kept in contact with the photoconductive drum 1, regardless of whether the corona electric charging unit 71 is retracted. Thus, there is a possibility that the continuous-form sheet 20, that is in contact with the photoconductive drum 1, will be stained by the toner on the photoconductive drum 1 when printing operation is resumed. For example, a black stripe is undesirably produced on the continuous-form recording sheet 20.

In the above state, since the wires of the brush 14 come into contact with the continuous-form sheet 20, the friction resistance of the wires prevents the continuous-form sheet 20 from being moved by the inertia as much as possible when it is stopped. Since the wires are released from being pressed by the continuous-form sheet 20, they return to their standing state by the elastic force thereof. Thus, the continuous-form sheet 20 is regulated so that it is loosened toward the corona electric charging unit 71 side, as shown in FIG. 3. In other words, since the wires of the brush 14 are easily bent only by the continuous-form sheet 20, upwardly pressed by means of the pressing member 76, the wires easily return to their standing state when the continuous-form sheet 20 is not upwardly pressed. Further, since the brush 14 is composed of a multiplicity of the planted wires each having a very weak elastic returning force, the brush 14 uniformly presses the continuous-form sheet 20 and securely causes it to be downwardly pressed.

With respect to the wires, it is possible to employ thin wires made by, for example, acrylic resin, respectively, having a predetermined elastic force. Further, it is possible to freely set a coefficient of friction for the wires with a sheet, an amount of area at which the wires are planted, length of wires and so forth, in so far as the above-described operation is definitely executed.

As described above, according to the transfer charger retracting mechanism of the printer using the continuous-form sheet, a direction in which the continuous-form sheet is loosened can be regulated by the elasticity of the wires of the brush, and thus the continuous-form sheet can be securely separated from the photoconductive drum when the printing operation is not carried out.

The present disclosure relates to subject matter contained in Japanese patent application No. 1-344120 (filed on Dec. 28, 1989) which is expressly incorporated herein by reference in its entirety.

What is claimed is:

1. A sheet separating mechanism, adapted to be positioned in an electrophotographic printer using a continuous-form sheet on which a visible image, having been formed on a predetermined photoconductive material, is to be transferred by means of a transferring charger, movable between an operating position, in which a pressing member adjacent to said transferring charger presses the continuous-form sheet being fed in a predetermined direction on the predetermined photoconductive material, and a retracting position in which said transferring charger is retracted from said operating position, for separating the continuous-form sheet from the predetermined photoconductive material, when said transferring charger is located at said retracting position;

said sheet separating mechanism comprising an elastic member arranged to contact the continuous-form sheet and be deformed by the continuous-form sheet said continuous form sheet is when said continuous form sheet is pressed by said pressing members when said transferring charger is located at said operating position, and said elastic member being released from the deformation when said transferring charger is located at said retracting position, whereby the continuous-form sheet is separated from said photoconductive material by said elastic member when said elastic member is released from the deformation.

2. The sheet separating mechanism according to claim 1, wherein said elastic member comprises a brush member having a multiplicity of wires made of a predetermined material.

3. The sheet separating mechanism according to claim 2, wherein said predetermined material is an acrylic resin.

4. The sheet separating mechanism according to claim 1, wherein said predetermined photoconductive material comprises a photoconductive drum arranged to be rotated with the feeding operation of the continuous-form sheet.

5. A sheet separating mechanism, adapted to be positioned in an electrophotographic printer using a continuous-form sheet on which a visible image, having been formed on a photoconductive drum, is to be transferred by means of a transferring charger movable between an operating position, in which a pressing member adjacent to said transferring charger presses the continuous-form sheet, being fed in a predetermined direction, on said photoconductive drum and a retracting position in which said transferring charger is retracted from said operating position, for separating the continuous-form sheet from said photoconductive drum when said transferring charger is located in said retracting position;

said sheet separating mechanism comprising a brush member having a multiplicity of wires, made of an acrylic resin, which are arranged to be deformed by the continuous-form sheet, pressed by said transferring charger when said transferring charger is located at said operating position, or to be released from the deformation when said transferring charger is located at said retracting position, whereby the continuous-form sheet is separated from said photoconductive drum by said wires released from the deformation.

* * * * *

UNITED STATES PATENT AND TRADEMARK OFFICE

CERTIFICATE OF CORRECTION

PATENT NO. : 5,220,396

DATED : February 18, 1992

INVENTOR(S) : Yoshio MONMA et al.

It is certified that error appears in the above-indentified patent and that said Letters Patent is hereby corrected as shown below:

On the cover, in section [57], "ABSTRACT", line 7, after "by a" insert ---pressing member adjacent to---.

At column 6, line 22 (claim 1, line 7) change "adjacent to" to ---cooperating with---.

At column 6, line 34 (claim 1, line 19) delete "said continuous form sheet is".

At column 6, line 36 (claim 1, line 21) change "members" to ---member---.

At column 6, line 62 (claim 5, line 7) change "adjacent to" to ---cooperating with---.

At column 8, lines 2-3 (claim 5, lines 21-22) change "transferring charger" to ---pressing member---.

Signed and Sealed this

Twenty-eighth Day of November 1995

*Attest:*

Bruce Lehman

BRUCE LEHMAN

*Attesting Officer*

*Commissioner of Patents and Trademarks*